US009494001B2

(12) United States Patent
Hallundbæk

(10) Patent No.: US 9,494,001 B2
(45) Date of Patent: Nov. 15, 2016

(54) SERVICE PANEL

(75) Inventor: Jørgen Hallundbæk, Græsted (DK)

(73) Assignee: WELLTEC A/S, Allerod (DK)

( * ) Notice: Subject to any disclaimer, the term of this patent is extended or adjusted under 35 U.S.C. 154(b) by 485 days.

(21) Appl. No.: 14/008,333

(22) PCT Filed: Mar. 29, 2012

(86) PCT No.: PCT/EP2012/055638

§ 371 (c)(1),
(2), (4) Date: Sep. 27, 2013

(87) PCT Pub. No.: WO2012/130940

PCT Pub. Date: Oct. 4, 2012

(65) Prior Publication Data

US 2014/0014369 A1 Jan. 16, 2014

(30) Foreign Application Priority Data

Mar. 30, 2011 (EP) ..... 11160496

(51) Int. Cl.

| | |
|---|---|
| ***E21B 23/08*** | (2006.01) |
| ***E21B 23/00*** | (2006.01) |
| ***E21B 23/14*** | (2006.01) |
| ***E21B 47/01*** | (2012.01) |

(52) U.S. Cl.

CPC ..... *E21B 23/00* (2013.01); *E21B 23/14* (2013.01); *E21B 47/011* (2013.01); *E21B 2023/008* (2013.01)

(58) Field of Classification Search

CPC ..... E21B 23/00; E21B 23/08; E21B 47/011
See application file for complete search history.

(56) References Cited

U.S. PATENT DOCUMENTS

| | | | |
|---|---|---|---|
| 4,928,031 | A | 5/1990 | Linyaev et al. |
| 6,705,406 | B2 | 3/2004 | Das et al. |

(Continued)

FOREIGN PATENT DOCUMENTS

| | | | |
|---|---|---|---|
| CN | 1748073 | A | 3/2006 |
| SU | 1201495 | A | 12/1985 |

(Continued)

OTHER PUBLICATIONS

International Search Report for PCT/EP2012/055638, mailed May 7, 2012.

(Continued)

*Primary Examiner* — William P Neuder
(74) *Attorney, Agent, or Firm* — Nixon & Vanderhye P.C.

(57) ABSTRACT

The present invention relates to a downhole tool comprising a tool housing for accommodating components of the downhole tool, the tool housing comprising; a first tool housing part having a first end face and a second end face, and an activation unit removably connected with the first tool housing part, the activation unit comprising: a second tool housing part, and a closing member removably connected with the second tool housing part, wherein the second tool housing part and the closing member together constitute a fluid-tight chamber wherein a fluid is retained, the fluid-tight chamber housing mechanical and/or hydraulic and/or electrical components, and wherein the activation unit may be separated from the first tool housing part while the closing member is connected with the second tool housing part. The invention further relates to a downhole system and to a method of performing services of a downhole tool.

14 Claims, 6 Drawing Sheets

(56) References Cited

U.S. PATENT DOCUMENTS

| | | | | |
|---|---|---|---|---|
| 2005/0257961 | A1 | 11/2005 | Snell et al. | |
| 2006/0054354 | A1 | 3/2006 | Orban | |
| 2006/0065395 | A1 | 3/2006 | Snell et al. | |
| 2010/0012315 | A1 | 1/2010 | McInally | |
| 2012/0037358 | A1 | 2/2012 | Ferkingstad et al. | |
| 2014/0014315 | A1* | 1/2014 | Hallundbæk ..... | E21B 23/14 166/55 |

FOREIGN PATENT DOCUMENTS

| | | |
|---|---|---|
| WO | WO 93/18277 | 9/1993 |
| WO | WO 2006/115418 | 11/2006 |
| WO | WO 2008/091157 | 7/2008 |
| WO | WO 2008/111844 | 9/2008 |
| WO | WO 2009/020397 | 2/2009 |
| WO | WO 2009/111693 | 9/2009 |
| WO | WO 2010/123375 | 10/2010 |

OTHER PUBLICATIONS

International Preliminary Report on Patentability for PCT/EP2012/055638, mailed Mar. 14, 2013.

Office Action dated Aug. 8, 2016 issued in Russian Application No. 2013147726/03 with English translation (10 pages).

* cited by examiner

SERVICE PANEL

This application is the U.S. national phase of International Application No. PCT/EP2012/055638, filed 29 Mar. 2012, which designated the U.S. and claims priority to Europe Application No. 11160496.3, filed 30 Mar. 2011, the entire contents of each of which are hereby incorporated by reference.

FIELD OF THE INVENTION

The present invention relates to a downhole tool, comprising a tool housing for accommodating components of the downhole tool, the tool housing comprising a first tool housing part having a first end face and a second end face, and an activation unit removably connected with the first tool housing part. Furthermore, the invention relates to a downhole system comprising the downhole tool according to the invention and an operational tool, and to a method of performing services of a downhole tool.

BACKGROUND ART

Downhole tools are used for operations inside boreholes of oil and gas wells. Downhole tools operate in a very harsh environment and must be able to withstand inter alia corrosive fluids, very high temperatures and pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

Well tools are often part of a larger tool string containing tools with different functionalities. A tool string may comprise both transportation tools for transporting the tool string in the well and operational tools for performing various operations downhole.

Various principles for downhole transportation tools, also denoted well tractors, have been developed and tested. The transportation tools are primarily used for transporting tool strings in horizontal or close to horizontal parts of the well where gravity is insufficient for driving the tool string forward.

The operation conditions of downhole tools require that the tools are properly serviced on a regular basis, e.g. between each operation downhole. Maintenance and repair time is often expensive as it prolongs the time for performing operations downhole and possible time without production on an oil rig. Therefore, a need exists for downhole tools that are easy and fast to service.

SUMMARY OF THE INVENTION

It is an object of the present invention to wholly or partly overcome the above disadvantages and drawbacks of the prior art. More specifically, it is an object to provide an improved downhole tool wherein essential components may be easy to access and fast to exchange. Moreover, it is an object to provide an improved downhole tool wherein components of the downhole tool may be demounted or replaced without having to dismantle the tool string and/or remove the downhole tool from the tool string.

The above objects, together with numerous other objects, advantages, and features, which will become evident from the below description, are accomplished by a solution in accordance with the present invention by a downhole tool extending in a longitudinal direction, comprising: a tool housing for accommodating components of the downhole tool, the tool housing comprising; a first tool housing part having a first end face and a second end face, and an activation unit removably connected with the first tool housing part, the activation unit comprising: a second tool housing part, and a closing member removably connected with the second tool housing part, wherein the second tool housing part and the closing member together constitute a fluid-tight chamber housing mechanical and/or hydraulic and/or electrical components, and wherein the activation unit may be separated from the first tool housing part while the closing member is connected with the second tool housing part.

The collection of the mechanical and hydraulic components in the activation unit provides an easily accessible components bay in the downhole tool. The activation unit comprising some of the more vulnerable and exposed components in the downhole tool can easily be dismantled and replaced by a new activation unit, e.g. in the case of a breakdown. Having the opportunity to replace a collection of components comprised in a unit instead of individual components saves valuable time and reduces the risk of error during assembly. In this regard, the harsh environment on board e.g. an offshore drilling rig, where the facilities for performing maintenance operations are very limited, has to be taken into consideration.

In one embodiment, fluid may be retained inside the fluid-tight chamber.

The chamber may thus be compensated by pressurising the fluid, whereby the chamber is prevented from collapsing when subject to high pressure downhole, and contaminated well fluid is further prevented from entering.

In another embodiment, a cavity may be provided in the second tool housing part and/or the closing member.

Moreover, the activation unit may further comprise a sealing member arranged between the second tool housing part and the closing member.

Said sealing member may be arranged in a recess in the second tool housing part along a periphery of the cavity of the second tool housing part, the sealing member being compressed between the second housing part and the removably mounted closing member.

The sealing member may be a sealing ring, such as an O-ring.

By having a separate sealing member, the sealing member may be replaced between downhole operations to improve the sealing capabilities of the fluid-tight chamber between two runs.

The downhole tool according to the invention may further comprise one or more members, shafts or pipes connected with the components inside the chamber, wherein the one or more members, shafts or pipes extend through the closing member.

Further, the one or more members, shafts or pipes may extend in a direction perpendicular to the closing member.

Moreover, the one or more members, shafts or pipes may be adapted for transferring mechanical forces and/or hydraulic pressure.

Also, the one or more members, shafts or pipes may be adapted for transferring mechanical forces and/or hydraulic pressure generated by the hydraulic and/or mechanical components inside the fluid-tight chamber.

Hereby, forces, pressure, etc. generated inside the fluid-tight chamber of the activation unit may be transferred to other components of the downhole tool.

In one embodiment, the one or more members, shafts or pipes extending through the closing member may extend into the first tool housing part.

In another embodiment, the downhole tool according to the invention may further comprise one or more arm assemblies being pivotally connected with the one or more members, shafts or pipes extending through the closing member, the arm assemblies being movable between a retracted position and a projecting position, wherein the arm assemblies project substantially radially outwards from the downhole tool.

Each of the arm assemblies may comprise an arm member being connected with the member, shaft or pipe extending through the closing member.

Furthermore, each of the arm assemblies may comprise a wheel, an anchor device, a casing penetration means or a centraliser device, connected with a movable end of the arm.

In yet another embodiment, the arm assembly may be arranged in a slot of the downhole tool between the first tool housing part and the activation unit.

Hereby, the arm assembly, when in its retracted position, may be protected by the tool housing of the downhole tool, e.g. when the tool is lowered down through a substantially vertical part of the well. Further, by the arm assembly being retractable into the tool housing, the downhole tool may have a larger diameter while being able to pass narrow passages of the well.

Also, the fluid-tight chamber may have a total volume defined by internal sides and bottom of the cavity in the second tool housing part and a surface of the closing member facing the cavity, the mechanical and/or hydraulic and/or electrical components arranged inside the cavity filling up 80-95% of the total volume of the cavity.

Hereby, a downhole tool having very good collapse resistance capabilities may be created, which is especially useful when the tool is exposed to the high pressure environment in a well.

In addition, the first tool housing part may have a length in the longitudinal direction of the downhole tool and may comprise a recess of a length extending in the longitudinal direction of the downhole tool.

Said length of the first tool housing part may be greater than the length of the recess, and the activation unit may have a length which is substantially equal to or less than the length of the recess.

Moreover, the first tool housing part may have a length in the longitudinal direction of the downhole tool, said length being greater than a length of the activation unit.

The recess may be arranged in a middle section of the first tool housing part and extending between two end pieces of the first tool housing part.

Also, the activation unit may be connected with the first tool housing part by connection members extending through the second tool housing part and the closing member and into contact with the first tool housing member.

The downhole tool according to the invention may comprise at least two tool housings wherein the first tool housing part of a first tool housing is connected to the first tool housing part of a second tool housing.

Further, the downhole tool may comprise an electronic section, an electrical motor and a hydraulic pump, the electronic section comprising inter alia control electronics for controlling the electricity supply to the electrical motor driving the hydraulic pump.

The present invention further relates to a downhole system comprising the downhole tool according to the invention and an operational tool connected with the downhole tool for being moved forward in a well or borehole.

In one embodiment, the operational tool may be a stroker tool, a key tool, a milling tool, a drilling tool, a logging tool, etc.

The present invention further relates to a method of performing services of a downhole tool according to the invention, the method comprising the steps of: demounting the activation unit from the first tool housing part, and remounting the activation unit that was previously mounted on the first tool housing part or mounting a replacement activation unit.

Hereby, the time spent on performing service or maintenance may be greatly reduced and the risk of error minimised. Further, the replacement activation unit may either be a brand new activation unit or an activation unit that has been serviced.

The method of performing services of a downhole tool according to the invention may comprise the steps of: demounting the activation unit from the first tool housing part, removing the closing member from the second tool housing part, replacing the sealing member, and remounting the activation unit on the first tool housing part.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
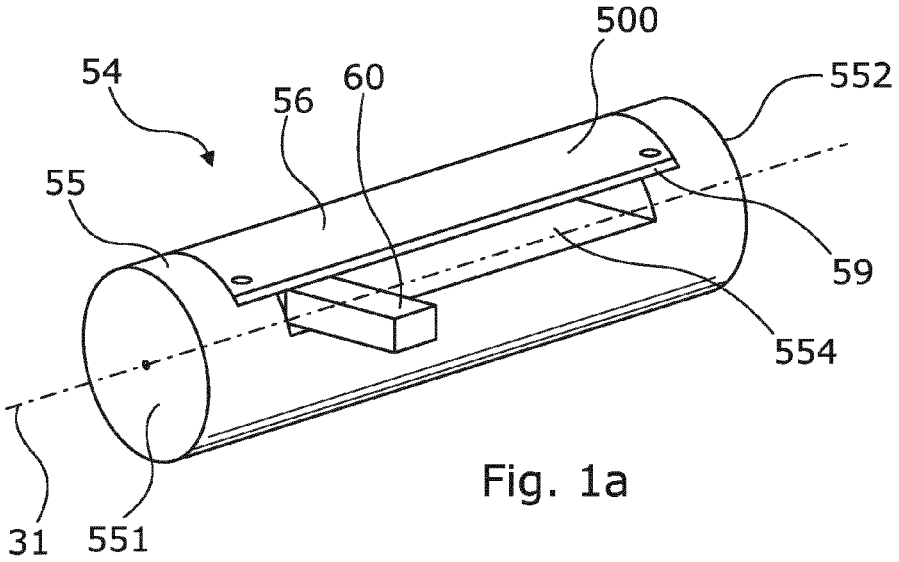
FIG. 1*a* shows a downhole tool in an assembled state.

FIG. 1*a* shows a tool housing 54 in its assembled state. The tool housing 54 has a centre axis 31 and extends in a longitudinal direction between a first end face 551 and a second end face 552. An arm assembly 60 is shown in a projecting position with its free end extending from the tool housing 54. One tool housing may accommodate multiple arm assemblies movable between a retracted position, wherein the arm assemblies are substantially encased by the tool housing 54, and a projecting position, wherein the free end of the arm assembly 60 projects from the downhole tool 11.

The arm assemblies 60 may have several different uses and could be used for accommodating wheels or other devices required to be able to move between a retracted position and an extending or projecting position. The arm assemblies 60 may also be used for other purposes such as for anchoring the tool in the well, for centralising the tool, as a mechanism for advancing casing penetration means, etc.

Figure 4:
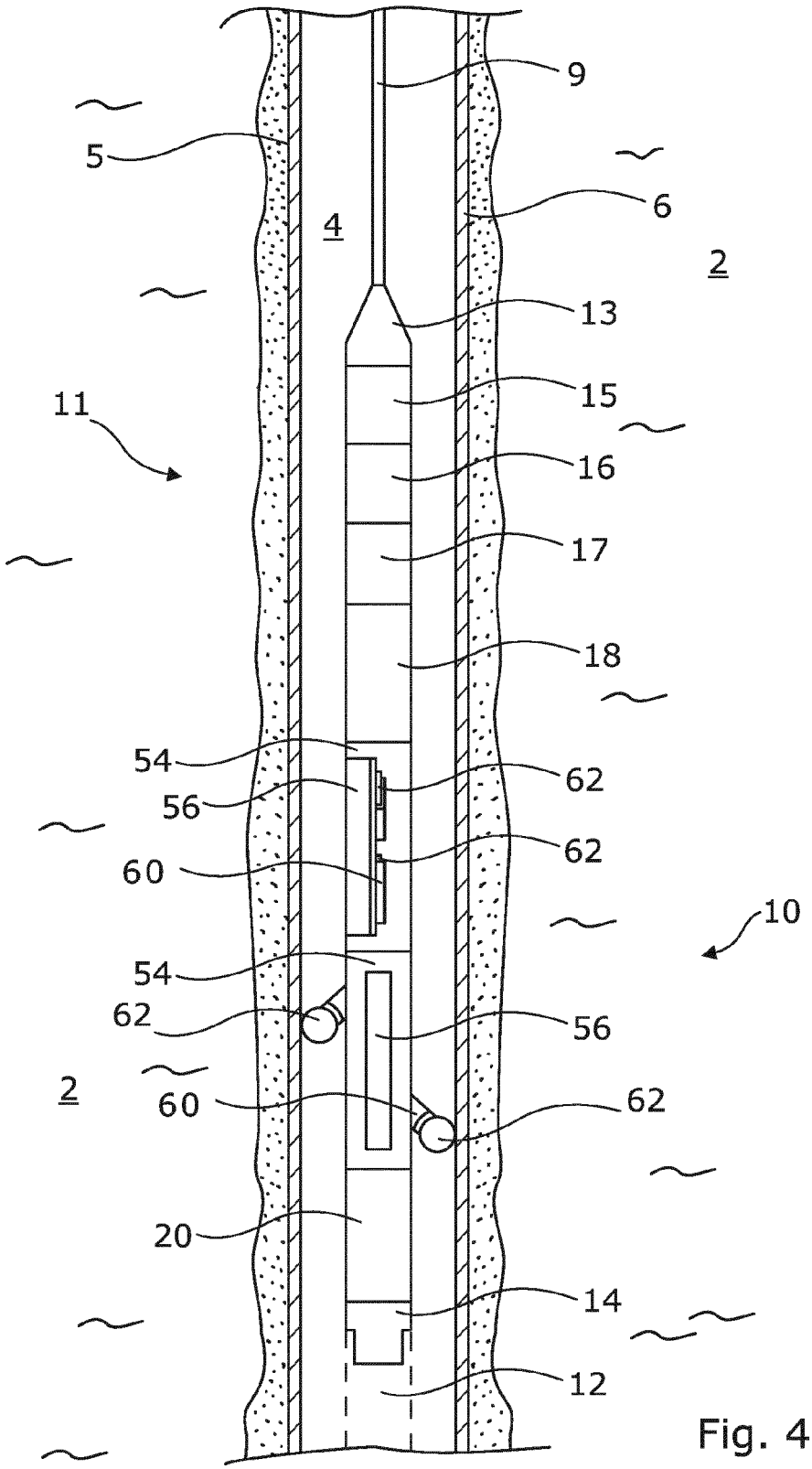
FIG. 4 shows a tool string comprising several downhole tools.

The tool housing 54 is part of a downhole tool 11 that may comprise several tool housings accommodating movable arm assemblies 60 as shown in FIG. 4. When used in a downhole tool 11, the tool housings 54 may be arranged end to end with their respective end faces joined together. The downhole tool 11 may in turn be part of a larger tool string 10 comprising multiple downhole tools with different functionalities.

Figure 1B:
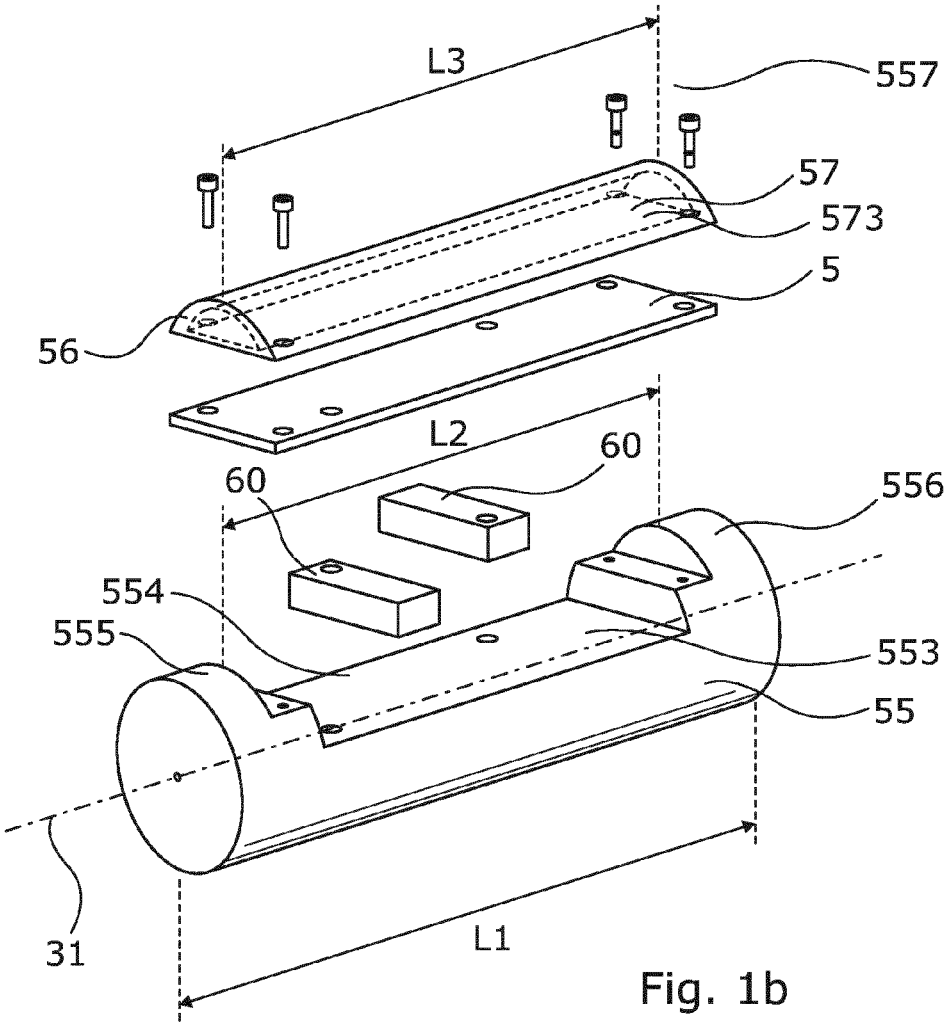
FIG. 1*b* shows an exploded view of the downhole tool of FIG. 1*a*.

The tool housing 54 shown in FIGS. 1*a* and 1*b* is divided into a first tool housing part 55 having a first end face 551 and a second end face 552, and an activation unit 500 removably connected with the first tool housing part 55. The activation unit 500 comprises a second tool housing part 56 and a closing member 59 removably connected therewith. The activation unit 500 may thus be separated from the first tool housing part 55 without removing the closing member 59 from the first tool housing part 55. However, in FIG. 1*b* the closing member 59 has been separated from the second housing part for illustrative purposes. FIG. 1*b* further shows two arm assemblies 60 in a projecting position. Several details, such as means for securing the arm assemblies 60 and the closing member 59, have been omitted for the sake of simplicity of the drawings.

The first tool housing part 55 is a substantially tubular member of length L1 having a recess 553 of length L2 extending in the longitudinal direction of the downhole tool 11. The recess is arranged in a middle section of the first tool housing part 55 and extends between two substantially tubular end pieces 555, 556. The activation unit 500 has a length L3 substantially equal to or less than the length L2 and is removably mounted in the recess 553. The activation unit 500 is connected with the first tool housing part 55 by connection members 557 extending through the second tool housing part 56 and the closing member 59 and into engagement with the first tool housing part. The connection members 557 may be bolts entering into threaded engagement with the first tool housing part or any other means known to the person skilled in the art.

With the activation 500 unit mounted in the recess in the first tool housing part 55, a slot 554 is provided between the activation unit 500 mounted and the first tool housing part 55. In the slot, one or more pivotally mounted arm assemblies 60 are arranged, as shown in FIG. 1*a*, and described below.

The second tool housing part 56 and the closing member 59 together constitute a fluid-tight chamber 573 by the second tool housing part 56 comprising a cavity 57 as indicated by the dotted lines in FIG. 1*b*. In the shown design, the closing member 59 is a plate-shaped element, but it may be of any suitable geometry or shape for creating a fluid-tight chamber along with the second tool housing part 56.

The activation unit 500 comprises some of the more vulnerable and exposed components in the downhole tool 11. The possibility of being able to remove the activation unit 500 provides an easy and fast way of repairing or replacing these essential parts without having to completely dismantle the downhole tool 11. If the activation unit 500 is malfunctioning, the unit may either be replaced or removed for repair. The fact that the activation unit 500 may be removed provides the opportunity of taking only part of the downhole tool 11 to a shielded environment, such as a tool shop compared to the deck of an oil rig, for repair.

Figure 2:
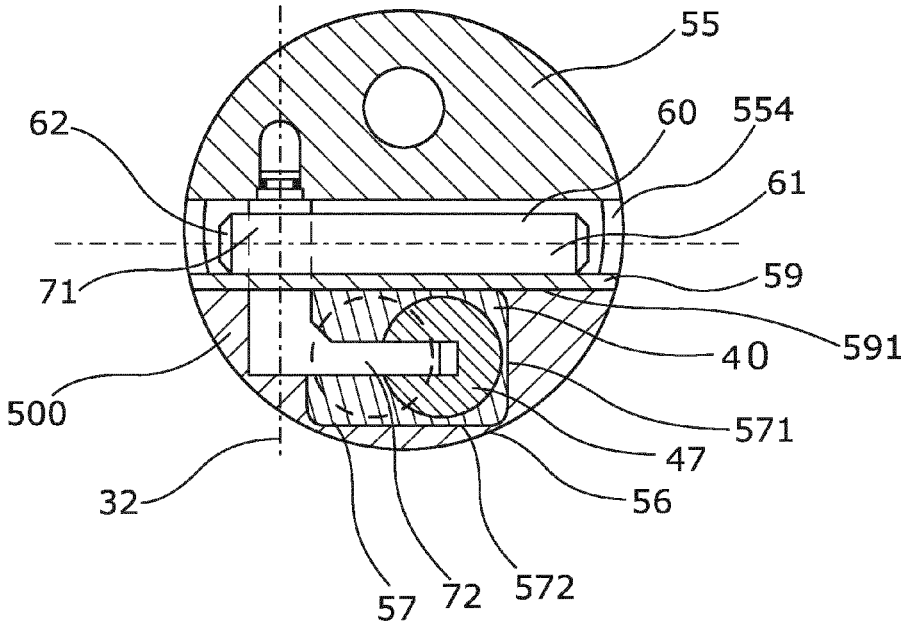
FIG. 2 shows a cross-sectional view of the downhole tool.
Figure 3:
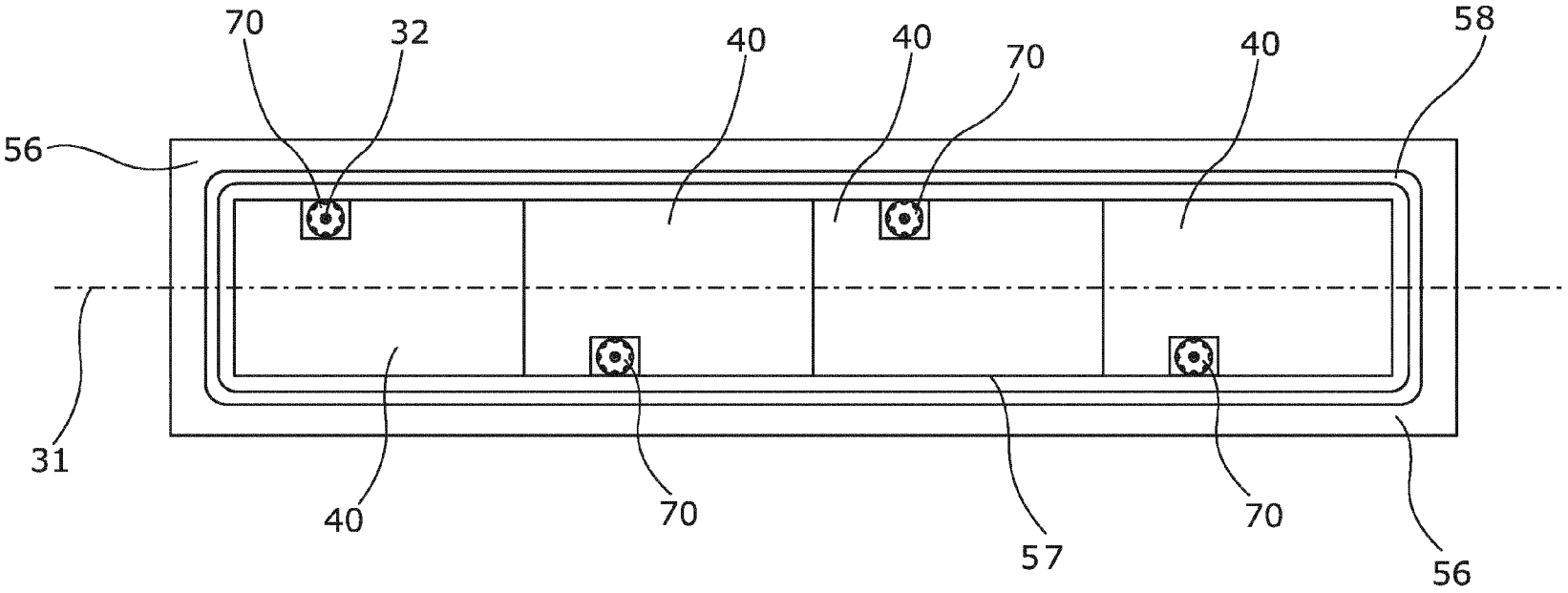
FIG. 3 shows the second tool housing part seen demounted from the first tool housing part and the closing member.

As shown in FIG. 3, four arm activation assemblies 40 are arranged in the cavity 57 of the second tool housing part 56. The fluid-tight chamber 573 may, however, be used for housing any type of components fitting in the cavity 57 such as, but not limited to, mechanical, hydraulic or electrical components. Each of the arm activation assemblies 40 are used for moving an arm assembly 60 between a retracted position and a projecting position. The arm activation assemblies 40 are supported by the bottom surface 572 of the cavity as shown in FIG. 2, and the fluid-tight chamber 573 has an inner geometry which substantially corresponds to the geometry of the arm activation assemblies 40.

In the shown design, the cavity 57 has an elongated shape extending in the longitudinal direction. The depth of the cavity is approximately half of its width and the bottom edges are rounded off. The side walls of the cavity are substantially perpendicular to a top surface 591 of the second housing part and opposite side walls are substantially parallel but may also be round or rounded off.

The total volume of the fluid-tight chamber 573 is defined by the bottom surface 572 and the side walls 571 of the cavity 57 and a surface 591 of the closing member 59 facing the cavity. When the arm activation assemblies 40 are arranged in the fluid-tight chamber, they fill up 75%-98% of the total volume of the chamber, preferably 85-98% of the total volume of the chamber.

To create the fluid-tight cavity, a sealing member 58 is provided between the closing member 59 and the second tool housing part 56. As shown in FIG. 3, the sealing member 58 is arranged along the periphery of the cavity 57 and when the closing member 59 is mounted on the second housing part, a fluid-tight seal is created. In this way, fluid is prevented from flowing into the cavity 57 or prevented from flowing out of the cavity 57. The sealing member 58 may be provided in a number of different designs known to the person skilled in the art, e.g. as a ring or gasket or as an integrated part of the closing member 59 or the second tool housing part 56. The sealing member 58 may also be plate-shaped covering the entire surface 591. The fluid-tight chamber both prevents fluid from entering and exiting the chamber.

As shown in FIG. 2, each arm activation assembly 40 comprises a crank constituted by a crank arm 72 and a crank shaft 71. The crank connects a piston member 47 inside the arm activation assembly 40 with the pivotally mounted arm assembly 60. The crank has the functionality of converting a transverse motion provided by the piston member 47 into to a rotation force for moving the arm assembly 60. Thus, the crank transfers mechanical forces generated by the arm activation assembly in the cavity. In addition or as an alternative, the crank may also be used for transferring hydraulic and/or electrical power into the arm assembly 60. This could e.g. be done by transferring a fluid through the crank shaft 71 or by providing cabling cast into, integrated into or run in the crank.

With the closing member 59 mounted on the plane side of second tool housing part 56, the crank shaft 71 of each of the arm activation assemblies 40 extend through the closing member 59 perpendicular to surface thereof. For the crank shaft 71 to be able to extend through the closing member 59, the closing member 59 comprises a number of through-going holes arranged in accordance with the number of crank shafts 71 utilised in the downhole tool 11. The through-going holes are equipped with a sleeve (not shown) to provide a fluid-tight or substantially fluid-tight connection between the crank shaft 71 and the closing member 59. In an alternative design, the rotational force provided by the crank may be transferred through the closing member 59 by a magnet clutch or other means not requiring through-going holes in the closing member 59.

Figure 5A:
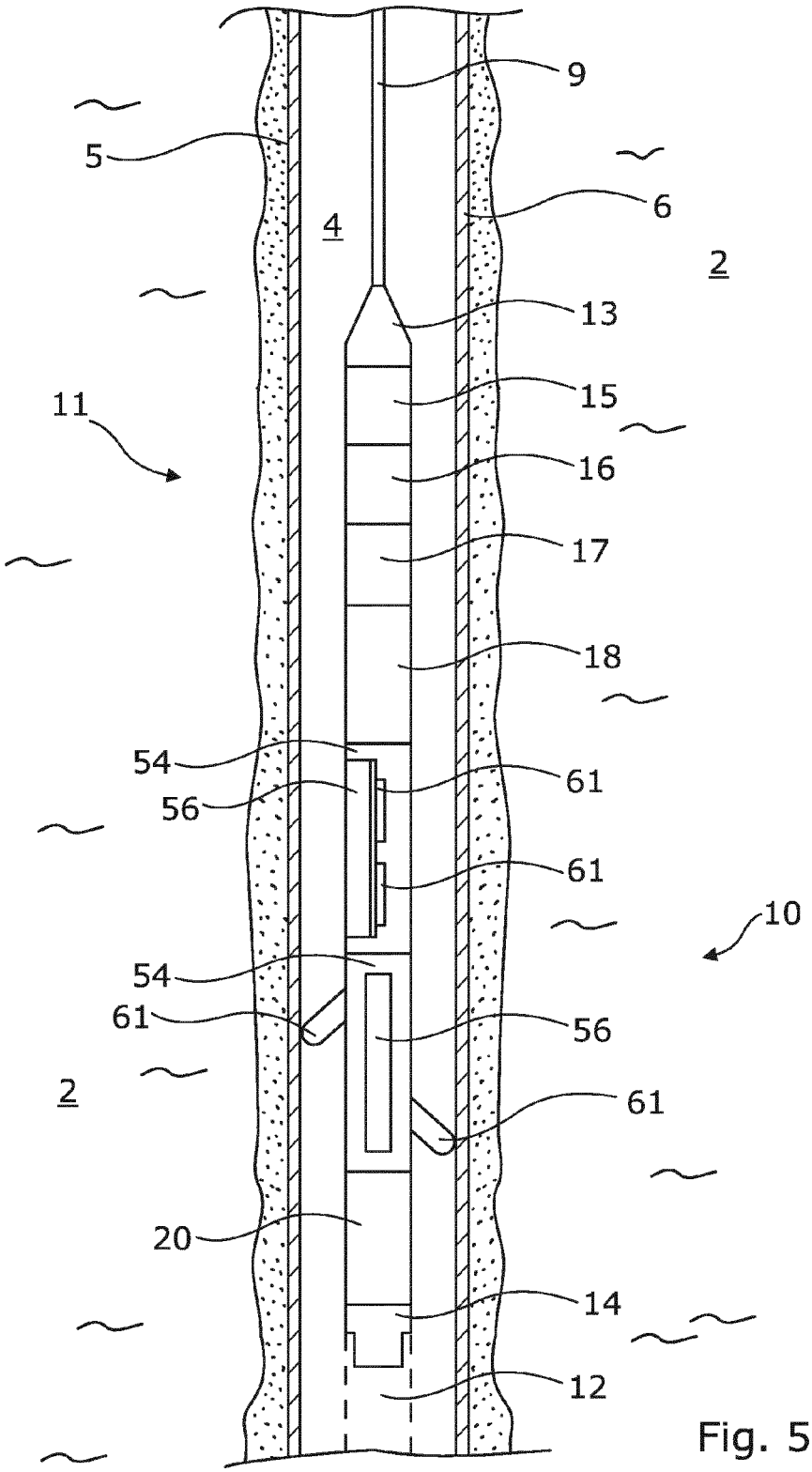
FIGS. 5*a* and 5*b* shows downhole tools with different arm assemblies.
Figure 5B:
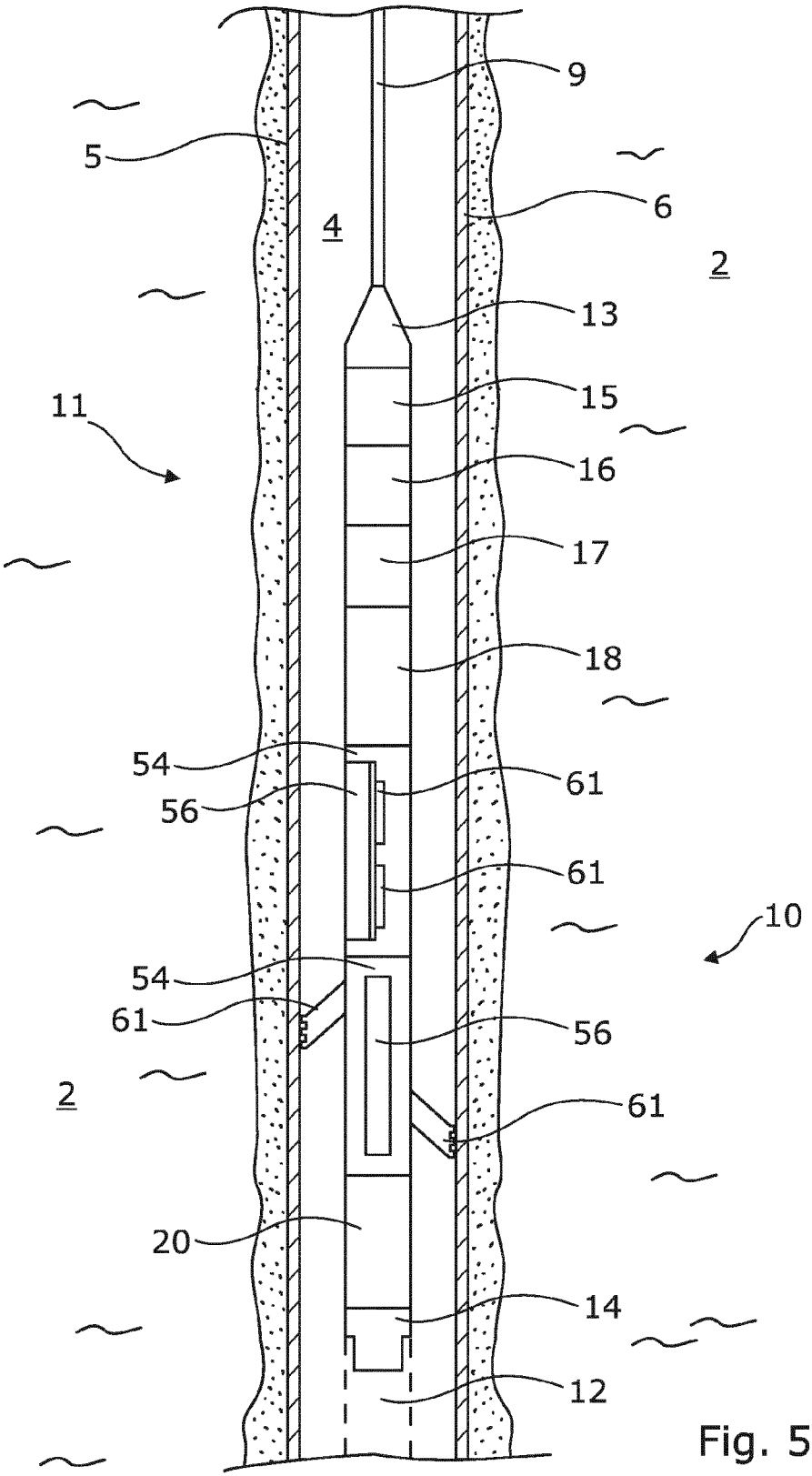

FIGS. 4, 5*a* and 5*b* show different downhole tools wherein the arm assemblies 60 have various configurations.

FIG. 4 shows a downhole tool 11 embodied as a driving unit 11 arranged in a casing in a well or borehole. The downhole tool 11 is powered through a wireline 9 which is connected with the tool through a top connector 13.

The downhole tool 11 comprises several tool housings 54 accommodating movable arm assemblies 60. The tool housings 54 are arranged end to end with their respective end faces joined together. The downhole tool 11 further comprises an electronic section having modeshift electronics 15 and control electronics 16 for controlling the electricity supply before it is directed to an electrical motor 17 driving a hydraulic pump 18. The downhole tool 11 may be connected to one or more operational downhole tools 12, thereby constituting a tool string 10. Such operational tools could be a stroker tool providing an axial force in one or more strokes, a key tool opening or closing valves in the well, positioning tools such as a casing collar locator (CCL), a milling tool, a drilling tool, etc.

The driving unit moves the tool string 10 forward by several wheels 62 projecting towards the casing or side walls of the well. The wheels are mounted on the movable arm assemblies 60 projecting from the tool housing 54. The arm assemblies 60 can be moved between a retracted position and a projecting position. In FIG. 4, the arm assemblies are shown in the projecting position, and when the wheels turn, the tool string 10 is propelled forward.

The driving unit 11 may be inserted into a well and is able to move an operational tool forward in the well. The driving unit 11 is most often used for moving an operational tool into a specific position in the well or just forward in the well while performing an operation, such as moving a logging tool forward while logging fluid and formation data in order to optimise the production of oil fluid from the well.

The arm assembly 60 shown in FIG. 2 comprises an arm member 61 and a wheel 62 mounted at a free end of the arm. Opposite the free end, the arm member 61 is pivotally mounted on the crank shaft 71 by the crank shaft comprising a pattern mating with a similar pattern (not shown) in a bore in the arm member 61. Hereby, the crank shaft 71 and the arm member 61 interlock whereby rotational force may be transferred from the crank to the arm assembly 60. The part of the crank shaft extending through the arm member extends further into the first housing part. In accordance with another application of the invention, the arm assembly 60 may be utilised without a wheel or comprising an anchor device, a casing penetration means or a centraliser device mounted at the free end as earlier mentioned. In FIG. 5*a*, the arm member has no wheel, but is instead designed with a curved free end which may be utilised when the arm assembly is part of a centraliser device. In FIG. 5*b* the free end of the arm member is equipped with teeth of serrations which may be used in an anchor device.

As previously described, the arm assembly 60 is arranged in the slot 554 between the activation unit 500 and the first tool housing part 55. By being pivotally mounted to the crank shaft 71, the arm assembly 60 may move between a retracted position wherein the arm assembly 60 is retracted into the slot 554 and a projecting position wherein the wheel and the majority of the arm member extend out of the slot. In the retracted position, the arm assembly 60 is encased by the tool housing 54, and the downhole tool 11 has a substantially tubular outer contour.

Before lowering the downhole tool into a well bore, the fluid-tight chamber 573 is filled with a fluid, such as, but not limited to, hydraulic liquid. The components arranged inside the cavity are thus immersed in or surrounded by a fluid. The fluid-tight capability of the chamber both prevents fluid inside the chamber from escaping and contaminated well fluid from entering. By pressurising the fluid inside the fluid-tight chamber and due to the matching geometry of the activation assembly and the inner walls of the cavity, the fluid-tight chamber 573 has a high collapse resistance and may withstand considerable forces exerted by the pressure in the wellbore.

When performing maintenance, service or overhaul on the downhole tool 11, the activation unit 500 is demounted from the first tool housing part 55. The activation unit 500 may then be replaced by a different replacement activation unit or the demounted activation unit may be serviced before being remounted. The replacement activation unit could for example be a brand new activation unit or an activation unit that has been serviced beforehand.

If the activation unit 500 is to be serviced, the arm assemblies 60 are removed from the activation unit 500 and the closing member 59 is separated from the second tool housing part 56. Hereby, the fluid-tight chamber is left open and an access is gained to the components inside the chamber. When needed, the sealing member 58 may be replaced before the closing member 59 is once again mounted on the second tool housing part 56 and the fluid-tight chamber is restored. The assembled activation unit 500 may then be remounted on the first tool housing part 55.

Although the invention has been described in the above in connection with preferred embodiments of the invention, it will be evident for a person skilled in the art that several modifications are conceivable without departing from the invention as defined by the following claims.

The invention claimed is:

1. A downhole tool extending in a longitudinal direction, comprising:

a tool housing for accommodating components of the downhole tool, the tool housing comprising;

a first tool housing part having a first end face and a second end face, and an activation unit removably connected with the first tool housing part, the activation unit comprising:

a second tool housing part, and a closing member removably connected with the second tool housing part, wherein the second tool housing part and the closing member together constitute a fluid-tight chamber wherein a hydraulic liquid is retained, the fluid-tight chamber housing mechanical and/or hydraulic and/or electrical components, and wherein the activation unit may be separated from the first tool housing part while the closing member is connected with the second tool housing part.

2. A downhole tool according to claim 1, wherein a cavity is provided in the second tool housing part and/or the closing member.

3. A downhole tool according to claim 1, wherein the activation unit further comprises a sealing member arranged between the second tool housing part and the closing member.

4. A downhole tool according to claim 1, further comprising one or more members, shafts or pipes connected with the components inside the chamber, wherein the one or more members, shafts or pipes extend through the closing member.

5. A downhole tool according to claim 4, wherein the one or more members, shafts or pipes extending through the closing member extend into the first tool housing part.

6. A downhole tool according to claim 5, further comprising one or more arm assemblies being pivotally connected with the one or more members, shafts or pipes extending through the closing member, the arm assemblies being movable between a retracted position and a projecting position, wherein the arm assemblies project substantially radially outwards from the downhole tool.

7. A downhole tool according to claim 1, wherein an arm assembly is arranged in a slot of the downhole tool between the first tool housing part and the activation unit.

8. A downhole tool according to claim 1, wherein the fluid-tight chamber has a total volume defined by internal sides and bottom of the cavity in the second tool housing part and a surface of the closing member facing the cavity, the mechanical and/or hydraulic and/or electrical components arranged inside the cavity filling up 80-95% of the total volume of the cavity.

9. A downhole tool according to claim 1, wherein the first tool housing part has a length (L1) in the longitudinal direction of the downhole tool and comprises a recess of a length (L2) extending in the longitudinal direction of the downhole tool.

10. A downhole tool according to claim 1, wherein the activation unit is connected with the first tool housing part by connection members extending through the second tool housing part and the closing member and into contact with the first tool housing member.

11. A downhole tool according to claim 1, comprising several tool housings are arranged end to end with their respective end faces joined together.

12. A downhole system comprising the downhole tool according to claim 1 and an operational tool connected with the downhole tool for being moved forward in a well or borehole.

13. A method of performing services of a downhole tool according to claim 1, the method comprising the steps of:

demounting the activation unit from the first tool housing part, and remounting the activation unit that was previously mounted on the first tool housing part or mounting a replacement activation unit.

14. A method of performing services of a downhole tool according to claim 1, the method comprising the steps of:

demounting the activation unit from the first tool housing part, removing the closing member from the second tool housing part, replacing the sealing member, and remounting the activation unit on the first tool housing part.

* * * * *